US011535978B2

(12) United States Patent
Wynn et al.

(10) Patent No.: US 11,535,978 B2
(45) Date of Patent: Dec. 27, 2022

(54) LAUNDRY DEVICE CONFIGURED TO SEALINGLY ENGAGE A VISOR OF A BALL CAP DURING CLEANING AND METHOD OF USE THEREOF

(71) Applicants: Vincent Wynn, Atlanta, GA (US); Keithaniel Johnson, Atlanta, GA (US)

(72) Inventors: Vincent Wynn, Atlanta, GA (US); Keithaniel Johnson, Atlanta, GA (US)

( * ) Notice: Subject to any disclaimer, the term of this patent is extended or adjusted under 35 U.S.C. 154(b) by 25 days.

(21) Appl. No.: 16/501,885

(22) Filed: Jun. 25, 2019

(65) Prior Publication Data

US 2019/0390397 A1 Dec. 26, 2019

Related U.S. Application Data

(60) Provisional application No. 62/763,700, filed on Jun. 26, 2018.

(51) Int. Cl.

| | |
|---|---|
| ***D06F 19/00*** | (2006.01) |
| ***D06F 95/00*** | (2006.01) |
| ***A42B 1/002*** | (2021.01) |

(52) U.S. Cl.

CPC ..... *D06F 95/008* (2013.01); *A42B 1/002* (2013.01)

(58) Field of Classification Search

CPC ..... D06F 95/008; A42B 1/002; A42C 1/06; A42C 3/00

See application file for complete search history.

(56) References Cited

U.S. PATENT DOCUMENTS

| | | | | |
|---|---|---|---|---|
| 2,734,197 A * | 2/1956 | Kreinik | A42B 1/18 | 2/195.1 |
| 3,166,766 A * | 1/1965 | Banello, Jr. | A42B 1/18 | 2/175.6 |
| 3,469,264 A * | 9/1969 | Harris | A42B 1/045 | 2/46 |
| 4,345,336 A * | 8/1982 | Plastino | A42B 3/10 | 2/171.1 |
| 4,491,256 A * | 1/1985 | Payne | D06F 59/02 | 223/24 |
| 5,003,639 A * | 4/1991 | White | A42B 1/18 | 2/195.1 |
| 5,012,531 A * | 5/1991 | Schoonover | A42B 1/002 | 2/46 |
| 5,659,896 A * | 8/1997 | Taylor | A61F 9/045 | 2/12 |

(Continued)

*Primary Examiner* — Clinton T Ostrup
*Assistant Examiner* — Andrew Wayne Sutton

(57) ABSTRACT

A laundry device and use thereof to sealingly engage a visor of a ball cap to be cleaned with a solvent. The laundry device includes at least one compressible sheet configured to contact at least a portion of at least one side of the visor continuously from side to side proximate an inner perimeter portion of the visor that faces and extends from a crown of the ball cap; first and second plates configured to sandwich the at least one compressible sheet and the visor therebetween, and having respective inner perimeter portions that face the crown, having respective outer perimeter portions that extend toward and optionally beyond the visor, and having a shape that accommodates the visor; and at least one attachment member that engages the first and second plates to join the plates and to compress and sealingly engage the at least one compressible sheet around the visor.

20 Claims, 7 Drawing Sheets

(56) References Cited

U.S. PATENT DOCUMENTS

| | | | | | |
|---|---|---|---|---|---|
| 5,701,607 | A * | 12/1997 | Kaiser | A42B 1/062 | 2/10 |
| 5,865,013 | A * | 2/1999 | Jackson | B65B 25/20 | 206/278 |
| 5,956,773 | A * | 9/1999 | LaMantia | A42B 1/062 | 2/181 |
| 6,081,933 | A * | 7/2000 | Partsch, IV | A42B 3/227 | 2/195.1 |
| 6,669,262 | B1 * | 12/2003 | Crotty, III | B60J 3/0278 | 296/97.1 |
| 7,051,406 | B1 * | 5/2006 | Morris | A42B 1/247 | 2/10 |
| 7,178,173 | B2 * | 2/2007 | Kronenberger | A42B 1/002 | 2/175.2 |
| 7,472,429 | B1 * | 1/2009 | Lawrence | A42B 1/002 | 2/209.13 |
| D624,287 | S * | 9/2010 | Shamchander | D2/892 | |
| 8,051,497 | B1 * | 11/2011 | Erhardt | A42B 1/067 | 2/175.6 |
| 8,191,175 | B1 * | 6/2012 | White | A42B 1/062 | 2/175.5 |
| 8,776,273 | B2 * | 7/2014 | Krause | A42B 3/06 | 2/411 |
| 2005/0172380 | A1 * | 8/2005 | Turkington | A42B 1/063 | 2/175.4 |
| 2007/0199833 | A1 * | 8/2007 | Hunt, Sr. | A45C 11/02 | 206/8 |
| 2019/0315282 | A1 * | 10/2019 | Murray | A42B 1/062 | |
| 2019/0390397 | A1 * | 12/2019 | Wynn | D06F 95/008 | |

* cited by examiner

LAUNDRY DEVICE CONFIGURED TO SEALINGLY ENGAGE A VISOR OF A BALL CAP DURING CLEANING AND METHOD OF USE THEREOF

CROSS-REFERENCE TO PRIOR APPLICATION(S)

This non-provisional application claims the benefit of the priority of U.S. Provisional Application No. 62/763,700 filed on Jun. 26, 2018, the entire contents of which are incorporated herein by reference.

BACKGROUND OF THE INVENTION

1. Field of the Invention

This invention relates to a laundry device and method of use thereof, more particularly to a laundry device for protecting the visor of a baseball-type cap (hereinafter "ball cap") from destructive contact with water during laundering and from destructive contact with solvent systems during commercial dry cleaning.

2. Background of the Related Art

Ball cap users are generally disappointed by the appearance of a ball cap after laundering in a clothes washer or dishwasher, particularly the visor portion, alternately known as a brim or bill, which is generally stiffened with cardboard and/or other solvent-sensitive fillers. Contact with water deteriorates cardboard and other stiffening materials, such as fillers and starches, resulting in loss of turgidity and agglomeration of material so that the ball cap visor becomes less useful as a sun guard and unsightly. For these reasons, ball cap wearers shun laundering their ball caps despite obvious soil from perspiration and hair oils. Even hand laundering provides a disappointing appearance because contact of the visor with water is virtually unavoidable.

Dry cleaning fluids contain organic solvents that may degrade the visor stiffening materials so that repeated dry cleaning may result in a disappointing appearance and generally is less effective for removing perspiration than water-based laundry fluids. Moreover, dry cleaning fluids may contain water, such as from humid ambient conditions, which may contribute to deterioration of stiffening materials like cardboard that are water sensitive.

Accordingly, it is an object of the present invention to provide a laundry device to solvent-proof the visor of a ball cap during cleaning and a method of use thereof that is effective to prevent the visor from contacting water during machine and hand laundering with water and water-based laundry fluids, and during commercial dry cleaning with solvents that may contain water or other substances that degrade the visor.

SUMMARY OF THE INVENTION

The object of the present invention is accomplished in a first embodiment by providing a laundry device to solvent-proof a visor of a ball cap to be cleaned with a solvent, including at least one compressible sheet that is solvent resistant, each compressible sheet of the at least one compressible sheet being configured to contact and cover at least a portion of at least one side of the visor continuously from side to side at least proximate to an inner perimeter portion of the visor that faces and extends from a crown of the ball cap; a first plate and a second plate configured to sandwich the at least one compressible sheet and the visor therebetween, the first plate and the second plate having respective inner perimeter portions that face the crown, having respective outer perimeter portions that extend beyond the visor, and each having a shape that accommodates the visor but is larger than the visor at least along the outer perimeter portions thereof; and at least one attachment member that engages the first plate and the second plate to join the first plate and the second plate and to compress the at least one compressible sheet around the visor so as to provide a solvent-tight engagement of the laundry device around at least a portion of the visor.

In the laundry device, the at least one compressible sheet may be a strip, two strips, more than two strips a sheet or two sheets that comprise an elastomeric material that compresses sufficiently to provide a solvent-tight engagement. The elastomeric material may be selected from the group consisting of a natural rubber, a synthetic rubber, and a foam.

The laundry device may include two compressible strips, one strip contacting one side of the visor and another strip contacting another side of the visor. The laundry device may include two compressible sheets, one sheet contacting and covering one side of the visor and another sheet contacting and covering another side of the visor, and wherein at least one sheet of the two compressible sheets extends to cover edge portions of the visor.

In a second embodiment, the inner perimeter portion of the visor has ends, and the first plate and second plate may each be provided with at least one continuous ridge that is disposed in the outer perimeter portion thereof inwardly of the attachment member and that extends from one end of the inner perimeter portion of the visor to another end of the inner perimeter portion of the visor. The respective at least one continuous ridge both face in the same direction so as to join and nest with one another to provide a sealing engagement of the outer perimeter portions thereof when the attachment member engages the first plate and the second plate.

The at least one attachment member may comprise a plurality of attachment members, wherein the first plate and the second plate each have defined therethrough a plurality of attachment holes disposed in the outer perimeter portion thereof, the plurality of attachment holes of the first plate corresponding to the plurality of attachment holes of the second plate so that each attachment member of the plurality of attachment members is inserted in registration through corresponding attachment holes in the first plate and the second plate. Each attachment member of the plurality of attachment members may be selected from the group consisting of a nut and bolt, a wingnut and bolt, a toggle, and the like.

Each attachment hole of the plurality of attachment holes in the first plate may be a slot. Then, each attachment member of the plurality of attachment members may comprise an anchor end that is anchored in the second plate, such as being provided with threads that are screwed into threads provided in the attachment holes of the second plate, a shaft extending from the anchor end toward the first plate, and a rotatable swivel end having a handle for entry of the attachment member into one slot in the first plate so that a retaining engagement of the handle with an outer surface of first plate is established. An outer surface of the first plate proximate to each slot may be provided with a protruding ridge configured to engage and retain a respective handle of the rotatable swivel end when the rotatable swivel end rotates the handle thereof into engagement with the protruding ridge.

The at least one compressible sheet may be at least one arcuate strip having an arcuate shape that parallels that of the inner perimeter portion of visor, wherein the first plate is provided with a recess along the inner perimeter portion thereof or the second plate is provided with a recess along the inner perimeter portion thereof or both the first plate and the second plate are provided with a respective recess along the inner perimeter portion thereof, and wherein one arcuate strip of the at least one arcuate strip is disposed within and extends outwardly from a respective recess.

In a third embodiment, the first plate and second plate may be connected with hinges to open and close the laundry device, and may be attached with at least one attachment member such as a latch. In this embodiment, the at least one continuous ridge that is disposed in the outer perimeter portion of each of the first plate and the second plate continues and is further disposed in the inner perimeter portion of each of the first plate and the second plate, the visor has ends along the inner perimeter portion thereof that joins and extends from the outer perimeter of the crown, and the first plate and second plate have respective ends that are disposed proximate to but outside of the ends of the visor. The first plate and the second plate are connected at the respective ends thereof each with a hinge that opens to permit insertion of the visor and closes to provide a sealing engagement between the first plate and the second plate.

In this embodiment, the at least one compressible sheet is a continuous strip disposed on one of the first plate or the second plate internally of the ridge thereof, or is a continuous strip disposed on each of the first plate and the second plate internally of the ridge thereof.

The at least one attachment member comprises a sliding latch that includes a stationary tab provided on an outermost portion of the outer perimeter of the second plate to extend toward the first plate; and a slidable member provided on a outermost portion of the outer perimeter of the first plate to extend toward the second plate, the slidable member including a vertical portion that slides to engage and thereby latch the stationary tab.

The laundry device of any embodiment disclosed here may be used to solvent-proof a visor of a ball cap by providing the laundry device; and inserting the visor of the ball cap into the laundry device to establish a solvent-tight engagement.

DETAILED DESCRIPTION OF THE INVENTION

Figure 1:
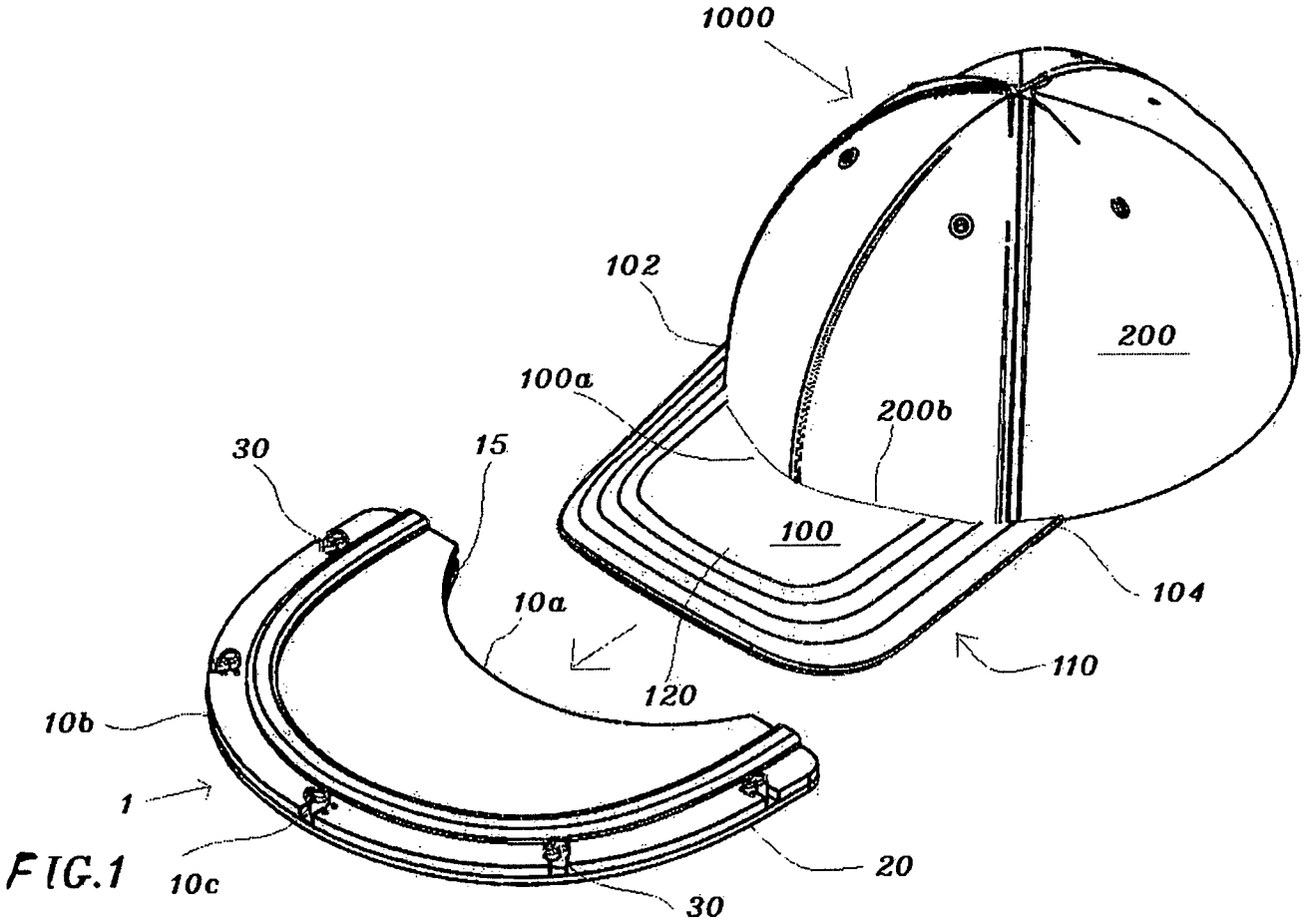
FIG. 1 illustrates an isometric top view of one embodiment of a laundry device for solvent-proofing a visor of a ball cap schematically shown being inserted into the laundry device.
Figure 2:
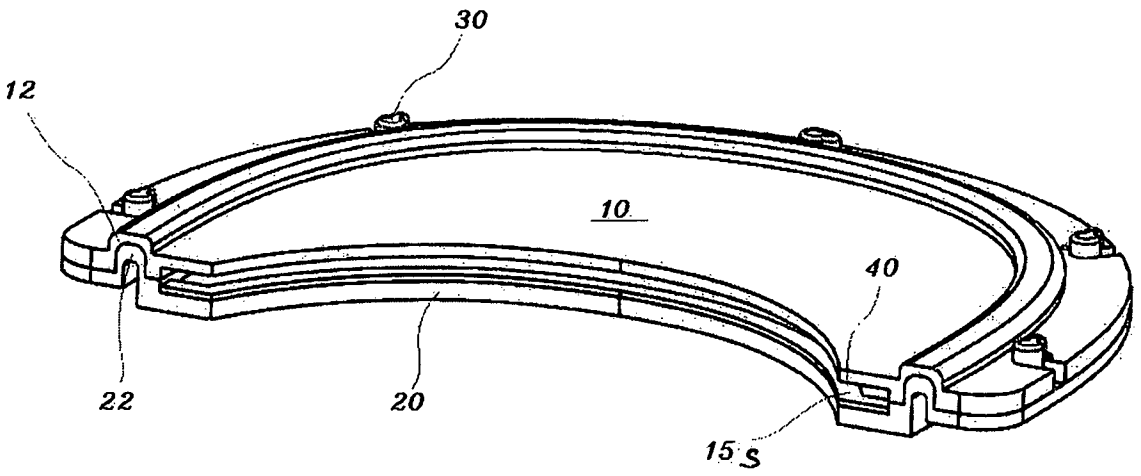
FIG. 2 illustrates an isometric edge view of the laundry device of FIG. 1.
Figure 3:
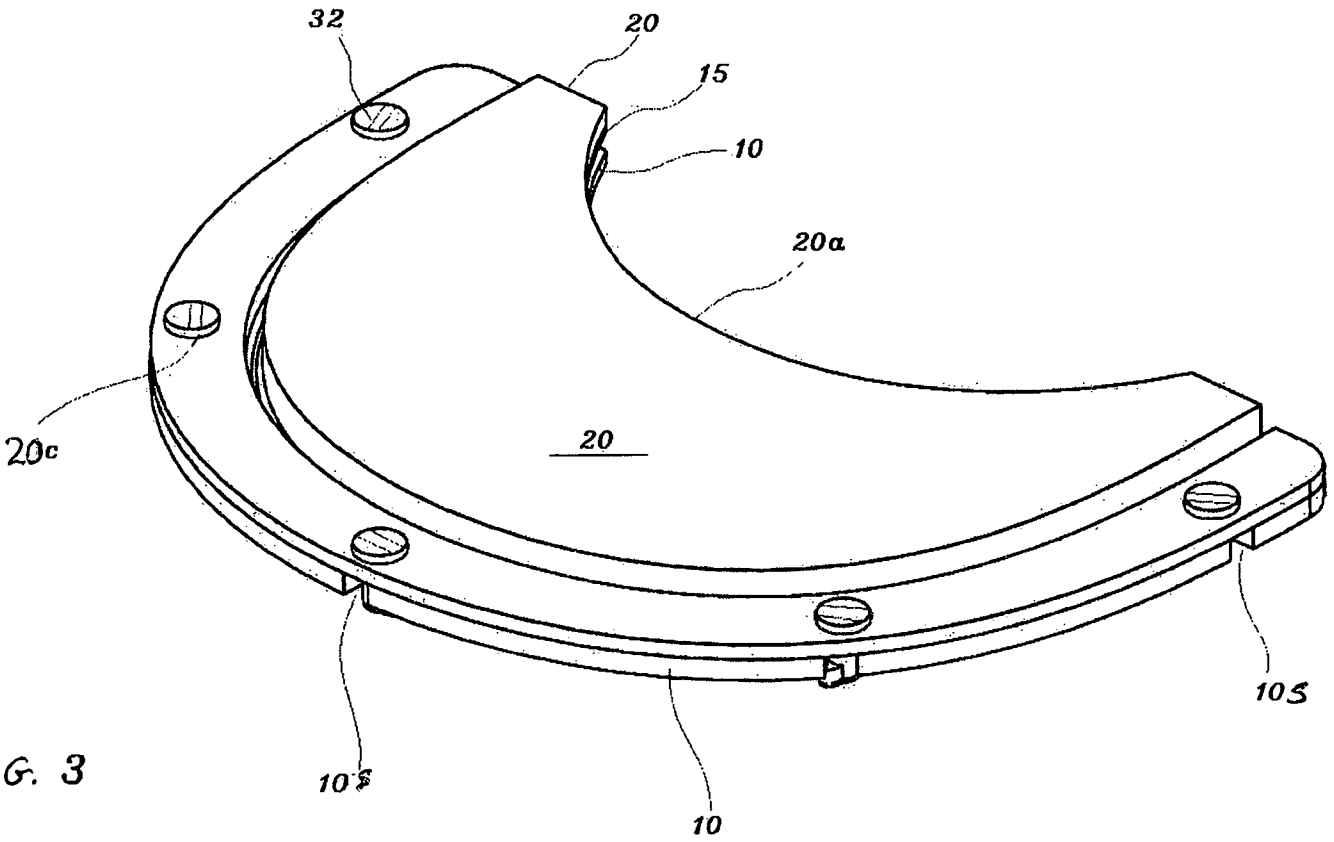
FIG. 3 illustrates an isometric bottom view of the laundry device of FIG. 1.

As shown in an embodiment illustrated in FIG. 1 through FIG. 4, a laundry device (1) for a visor (100) of a ball cap (1000), includes at least one compressible sheet or strip (15), each compressible sheet or strip (15) being configured to contact at least a portion of one side (110, 120) of the visor (100) continuously along an inner perimeter portion (100*a*) of the visor (100) that extends from an outer perimeter portion (200*b*) of a crown (200) of the ball cap (1000) to provide a seal. A first plate (10) and a second plate (20) are provided and are configured to sandwich the at least one compressible sheet or strip (15) and the visor (100) in a solvent tight engagement. The first plate (10) or the second plate (20) may be a top plate or a bottom plate, but FIGS. 1, 2, and 3 show the first plate (10) on the top, i.e., configured to engage a top side (120) of the visor (100) and the second plate (20) on the bottom, i.e. configured to engage a bottom side (110) of the visor (100).

The first plate (10) and the second plate (20) have respective inner perimeter portions (10*a*,20*a*) disposed proximate the inner perimeter portion (100*a*) of the visor (100) in use. The first plate (10) and the second plate (20) have respective outer perimeter portions (10*b*,20*b*) that respectively have defined therein a plurality of attachment holes (10*c*, 20*c*) in the respective outer perimeter portions (10*b*,20*b*) thereof. When the first and second plates (10,20) are assembled, the attachment holes (10*c*) of the first plate (10) are in registry with corresponding attachment holes (20*c*) of the second plate (20) and the assembled first and second plates (10,20) have a shape that accommodates the visor (100) but is larger than the visor (100) along an outer perimeter (100*b*) of the visor (100).

A plurality of attachment devices (30) are disposed in the second plate (20) and are configured to protrude through respective attachment holes (20*c*) of the plurality of attachment holes (20*c*) of the second plate (20) into respective attachment holes (10*c*) of the plurality if attachment holes (10*c*) in the first plate (10), in registry. The plurality of attachment devices (30) are configured to sealingly connect the outer perimeter portions of the first and second plates (10,20) together in a sandwiched configuration to provide the solvent tight engagement of the laundry device around the visor (100) of the ball cap (1000).

The at least one compressible sheet or strip (15) is shown in FIG. 2 as an arcuate strip (15*s*) but may be a pair of arcuate strips (15*s*) respectively positioned on either side of the visor (100), or a full sheet (15) or a pair of full sheets (15) that completely cover the visor respectively on one or both sides (110,120) of the visor (100). The sealing engagement may be augmented when the compressible sheet or strip (15) is a full compressible sheet (15) disposed in contact with one entire side (110 or 120) of the visor (100) or a pair of full compressible sheets (15) disposed one on each full side (110,120) of the visor (100). When the compressible sheet (15) is an arcuate strip (15*s*), either the first plate (10) or the second plate (20) or both may be provided with a recess (40) along the inner perimeter portion (10*a*,20*a*) thereof and one or two arcuate strips (15*s*) may be disposed within the recess(es) (40). In FIGS. 1 and 2, recess (40) is illustrated as being provided in the first plate 10.

The inner perimeter portion (100*a*) of the visor (100) has ends (102, 104). The first and second plates (10,20) may be provided with ridges (12,22) that nest with one another in the respective outer perimeter portions (10*b*,20*b*) thereof inwardly of the respective plurality of attachment holes (10*c*, 20*c*) and that extend from one end (102) to another end (104) of the visor (100) in use. The nested ridges (12,22) create a sealing engagement when the attachment devices are sealingly connected. The sealing engagement may be augmented when the compressible sheet or strip (15) is one full sheet (15) or a pair of full sheets (15) as discussed above.

Figure 4:
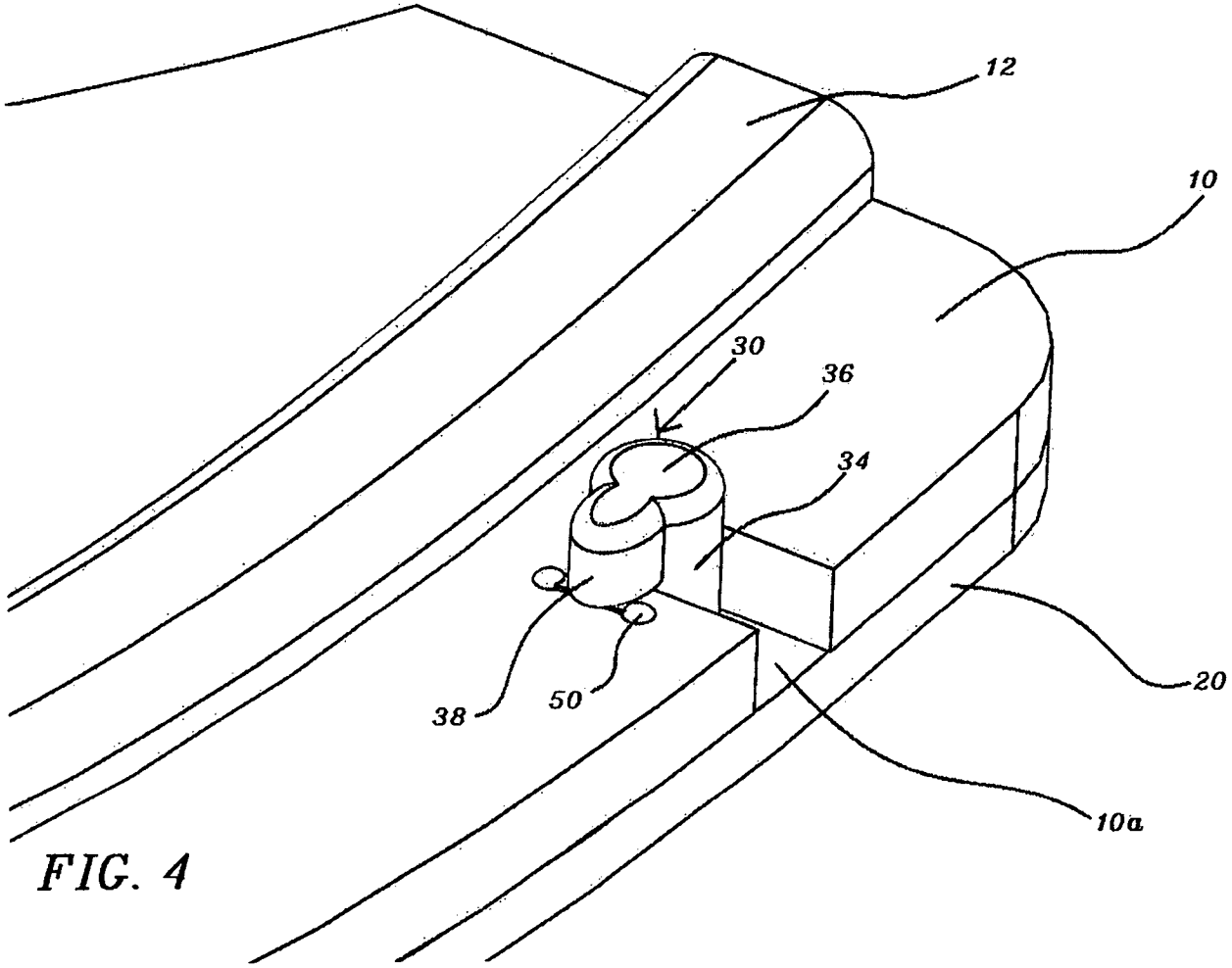
FIG. 4 illustrates an enlarged isometric bottom view of FIG. 3 showing more detail of a slot and an attachment device.

The attachment holes (10*c*) in the first plate (10) are illustrated in FIGS. 3 and 4 as slots (10*s*). As shown in FIGS. 3 and 4, the plurality of attachment devices (30) may each comprise an anchor end (32) from which extends a shaft (34), and a rotatable swivel end (36) having a handle (38). Each rotatable swivel end (36) rotates (swivels) to permit entry of the attachment device (30) into a respective slot (10*s*) and to permit a retaining engagement of the handle (38) with an outer surface of first plate (10) by swiveling the handle (38) onto an outer surface of the first plate (10).

The outer surface of the first plate (10) proximate to each slot (10*s*) may be provided with a retaining ridge (50) configured to engage and retain one respective handle (38).

Figure 5:
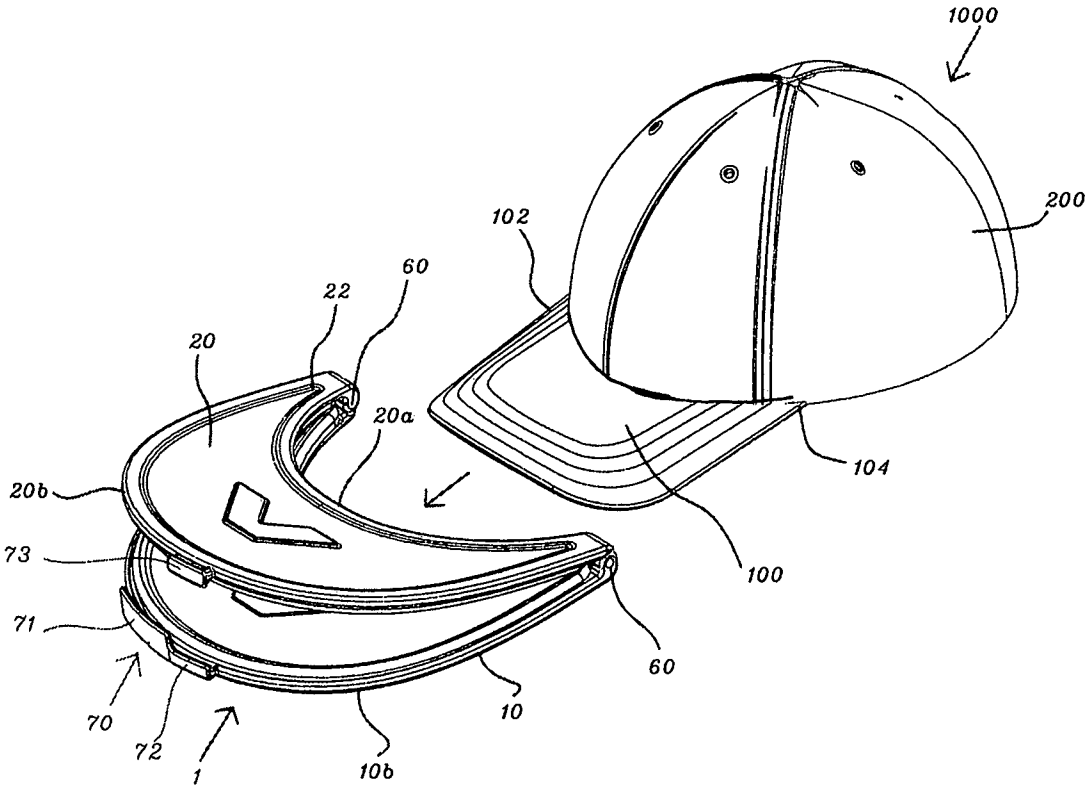
FIG. 5 illustrates an isometric top view of another embodiment of the laundry device in which the first and second plates are joined with hinges and secured with a sliding latch and are opened to receive insertion of a ball cap visor.
Figure 6:
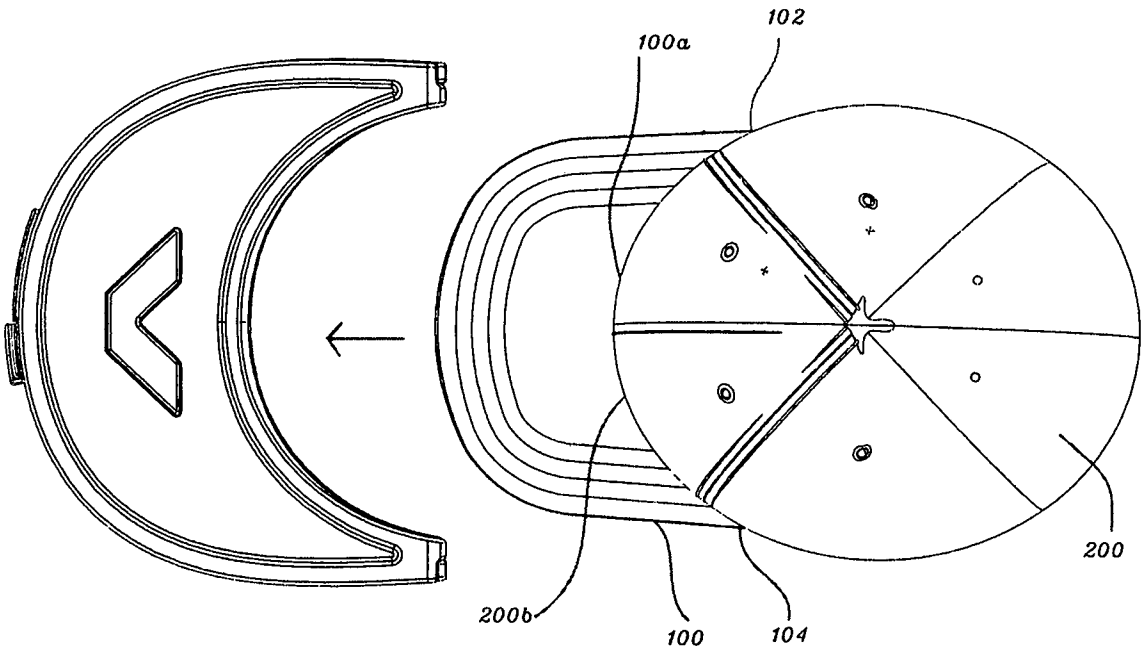
FIG. 6 illustrates a top view of the embodiment of FIG. 5.
Figure 7:
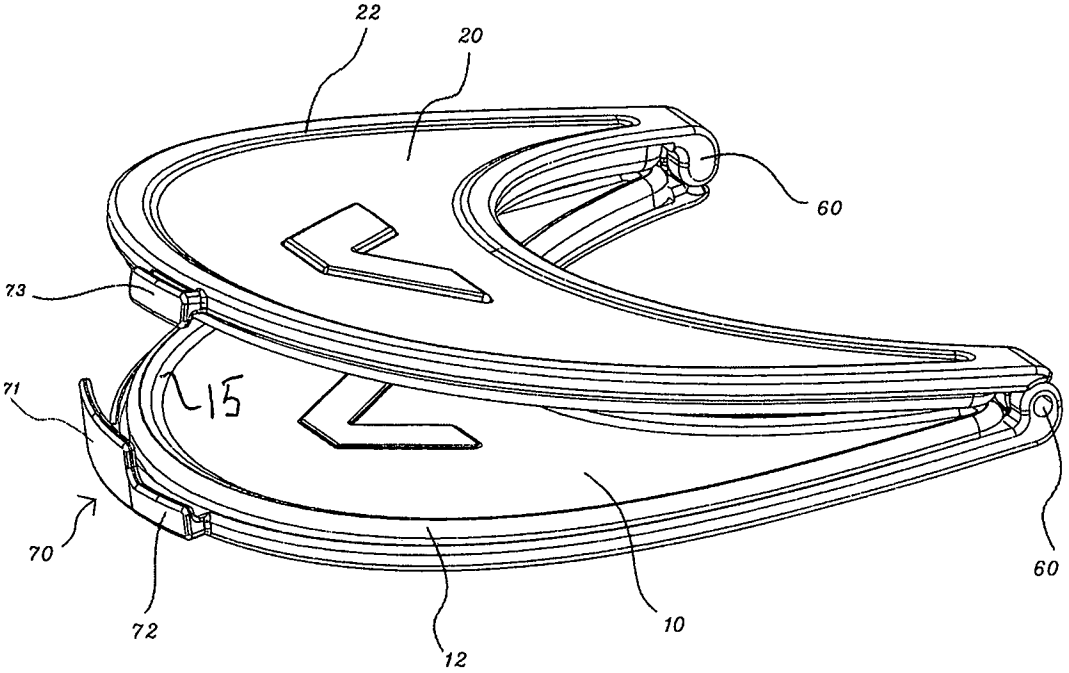
FIG. 7 illustrates an enlarged view isometric view of the laundry device of FIGS. 5 and 6.

In a third embodiment illustrated in FIGS. 5-7, the first plate (10) and the second plate (20) have respective ends that are disposed proximate to but outside of the ends (102,104) of the visor (100) along the inner perimeter portion (100*a*) thereof and that are connected at the respective ends thereof each with a hinge (60) that articulates to permit opening of the first plate (10) and the second plate (20) for insertion of the visor (100) into the laundry device and to close the first plate (10) and the second plate (20) around the visor (100) to provide a sealing engagement therebetween.

In this embodiment, the at least one continuous ridge (12,22) that is disposed in the outer perimeter portion (10*b*,20*b*) of each of the first plate (10) and the second plate (20) continues and is further disposed in the inner perimeter portion (10*a*,20*a*) of each of the first plate (10) and the second plate (20).

In this embodiment, the at least one compressible sheet is a continuous strip (15) disposed on one of the first plate (10) or the second plate (20) preferably internally of the ridge (12,22) thereof, or is a continuous strip (15) disposed on each of the first plate (10) and the second plate (20) internally of the respective ridges (12,22) thereof.

In this embodiment, the at least one attachment member (30) comprises a sliding latch (70) that includes a stationary tab (73) provided on an outermost portion of the outer perimeter (20*b*) of the second (20) to extend toward the first plate (10); and a slidable member provided on a outermost portion of the outer perimeter (10*b*) of the first plate (10) to extend toward the second plate (20), the slidable member including a vertical portion (71) that slides to engage and thereby latch the stationary tab (73) and a vertical portion 72 that is shorter than the vertical portion (71) and permits closure of the first plate (10) and the second plate (20) during latching.

The at least one compressible sheet or strip (15) may comprise an elastomeric material that compresses sufficiently to provide a solvent-tight engagement. Examples of elastomeric materials include, but are not limited to, natural rubber, a synthetic rubber or a compressible foam. Preferably, an elastomeric material is selected that is resistant to water and water-based laundry fluids, and to commercial dry-cleaning solvents that may degrade the elastomeric material. More preferably, the elastomeric material is selected to be insoluble in water, water-based laundry fluids, and commercial dry-cleaning solvents.

For a consumer's use, molded parts, such as the first and second plates (10,20), may be made of a molded polymer resin, such as polypropylene, a polycarbonate, or a polymethacrylate. For a commercial drycleaner's use, molded parts may be made of more durable materials, such as metal, for example, aluminum or steel.

The invention includes a method of using the laundry device based on the specifics of the embodiment. In each embodiment, the visor (100) of the ball cap (1000) is inserted between the first and second plates (10,20) and closed to provide a solvent-tight engagement of the laundry device (1) around at least a portion of the visor. When the level of soil of the visor (100) is great, particularly near the crown (200), the user may elect to sandwich the first and second plates (10,20) around the visor (100) so as to purposely expose the soiled portions of the visor to solvent cleaning.

In the embodiment featuring attachment holes (10*c*,20*c*) and attachment members (30), insertion of the visor (100) is followed by inserting each attachment member (30) in registration through corresponding attachment holes (10*c*, 20*c*) in the first plate (10) and the second plate (20) to establish a solvent-tight engagement.

In the embodiment featuring hinges for the first plate (10) and the second plate (20), insertion is followed by closing the hinges to sandwich the first plate (10) and the second plate (20) together. Then, the sliding attachment latch (70) is closed to establish a solvent-tight engagement.

Although the invention has been described with respect to specific embodiments for a complete and clear disclosure, the appended claims are not to be thus limited but are to be construed as embodying all modifications and alternative constructions that may occur to one skilled in the art which fairly fall within the basic teaching herein set forth.

What is claimed is:

1. A laundry device configured to sealingly engage a visor of a ball cap to be cleaned with a solvent, comprising:

at least one compressible sheet that comprises a material that is compressible and solvent resistant, each compressible sheet of the at least one compressible sheet being configured to contact and cover at least one side of the visor continuously from side to side proximate to an inner perimeter portion of the visor that faces and extends from a crown of the ball cap and to extend to cover an outer perimeter portion of the visor;

a first plate and a second plate configured to sandwich the at least one compressible sheet and the visor therebetween, the first plate and the second plate having respective inner perimeter portions that face the crown and having respective outer perimeter portions that extend toward the outer perimeter portion of the visor, and each having a shape that accommodates the visor; and at least one attachment member that engages the first plate and the second plate to join the first plate and the second plate and to compress the at least one compressible sheet around the visor so as to provide a sealing engagement of the laundry device around the visor, wherein two compressible sheets are provided, one sheet contacting and covering one side of the visor and another sheet contacting and covering another side of the visor, and wherein at least one sheet of the two compressible sheets extends to cover edge portions of the visor.

2. The laundry device according to claim 1, wherein the material that comprises the at least one compressible sheet is an elastomeric material that compresses sufficiently to provide the sealing engagement.

3. The laundry device according to claim 2, wherein the elastomeric material is selected from the group consisting of a natural rubber, a synthetic rubber, and a foam.

4. The laundry device according to claim 1, wherein at least one sheet of the two compressible sheets extends to cover outer perimeter edge portions of the visor and the two compressible sheets are sealed together.

5. The method of solvent-proofing a visor of a ball cap to be cleaned with a solvent, comprising:

providing the laundry device according to claim 1; and inserting the visor of the ball cap into the laundry device to establish the sealing engagement.

6. The laundry device according to claim 1, wherein the at least one attachment member comprises two attachment members, wherein the first plate and the second plate each have defined therethrough a plurality of attachment holes disposed in the outer perimeter portion thereof, and wherein the plurality of attachment holes of the first plate corresponding to the plurality of attachment holes of the second plate so that each attachment member of the plurality of attachment members is inserted in registration through corresponding attachment holes in the first plate and the second plate.

7. The laundry device according to claim 6, wherein each attachment member of the two attachment members is selected from the group consisting of a nut and bolt, a wingnut and bolt, and a toggle.

8. A laundry device configured to sealingly engage a visor of a ball cap to be cleaned with a solvent, comprising:

at least one compressible sheet that comprises a material that is compressible and solvent resistant, each compressible sheet of the at least one compressible sheet being configured to contact and cover at least a portion of at least one side of the visor continuously from side to side at least proximate to an inner perimeter portion of the visor that faces and extends from a crown of the ball cap;

a first plate and a second plate configured to sandwich the at least one compressible sheet and the visor therebetween, the first plate and the second plate having respective inner perimeter portions that face the crown, having respective outer perimeter portions that extend beyond the visor, and each having a shape that accommodates the visor but is larger than the visor at least along the outer perimeter portions thereof; and at least one attachment member that engages the first plate and the second plate to join the first plate and the second plate and to compress the at least one compressible sheet around the visor so as to provide a sealing engagement of the laundry device around at least a portion of the visor, wherein the inner perimeter portion of the visor has ends, and wherein the first plate and second plate are each provided with at least one continuous ridge that is disposed in the outer perimeter portion thereof inwardly of the attachment member and that extends from one end of the inner perimeter portion of the visor to another end of the inner perimeter portion of the visor, the respective at least one continuous ridges both facing in the same direction so as to join and nest with one another to provide a sealing engagement of the outer perimeter portions thereof when the attachment member engages the first plate and the second plate.

9. The laundry device according to claim 8, wherein the at least one compressible sheet is two compressible strips, one strip contacting one side of the visor and another strip contacting another side of the visor.

10. The laundry device according to claim 8, wherein the at least one attachment member comprises a plurality of attachment members, wherein the first plate and the second plate each have defined therethrough a plurality of attachment holes disposed in the outer perimeter portion thereof, the plurality of attachment holes of the first plate corresponding to the plurality of attachment holes of the second plate so that each attachment member of the plurality of attachment members is inserted in registration through corresponding attachment holes in the first plate and the second plate.

11. The laundry device according to claim 10, wherein each attachment member of the plurality of attachment members is selected from the group consisting of a nut and bolt, a wingnut and bolt, and a toggle.

12. The laundry device according to claim 10, wherein each attachment hole of the plurality of attachment holes in the first plate is a slot, wherein each attachment member of the plurality of attachment members comprises an anchor end that is anchored in the second plate, a shaft extending from the anchor end toward the first plate, and a rotatable swivel end having a handle for entry of the attachment member into one slot in the first plate so that a retaining engagement of the handle with an outer surface of first plate is established.

13. The laundry device according to claim 12 wherein an outer surface of the first plate proximate to each slot is provided with a protruding ridge configured to engage and retain a respective handle of the rotatable swivel end when the rotatable swivel end rotates the handle thereof into engagement with the protruding ridge.

14. The method of solvent-proofing a visor of a ball cap to be cleaned with a solvent, comprising:

providing the laundry device according to claim 10; and inserting the visor of the ball cap into the laundry device, inserting each attachment member in registration through corresponding attachment holes in the first plate and the second plate to establish the sealing engagement.

15. The laundry device according to claim 8, wherein the at least one compressible sheet is at least one arcuate strip having an arcuate shape that parallels that of the inner perimeter portion of visor, wherein the first plate is provided with a recess along the inner perimeter portion thereof or the second plate is provided with a recess along the inner perimeter portion thereof or both the first plate and the second plate are provided with a respective recess along the inner perimeter portion thereof, and wherein one arcuate strip of the at least one arcuate strip is disposed within and extends outwardly from a respective recess.

16. The laundry device according to claim 8, wherein the at least one continuous ridge that is disposed in the outer perimeter portion of each of the first plate and the second plate continues and is further disposed in the inner perimeter portion of each of the first plate and the second plate, wherein the visor has ends along the inner perimeter portion thereof that joins and extends from the outer perimeter of the crown, wherein the first plate and second plate have respective ends that are disposed proximate to but outside of the ends of the visor, and wherein the first plate and the second plate are connected at the respective ends thereof each with a hinge that opens to permit insertion of the visor and closes to provide a sealing engagement between the first plate and the second plate.

17. The laundry device according to claim 16, wherein the at least one compressible sheet is a continuous strip disposed on one of the first plate or the second plate internally of the ridge thereof, or is a continuous strip disposed on each of the first plate and the second plate internally of the ridge thereof.

18. The laundry device according to claim 17, wherein the at least one attachment member comprises a sliding latch that includes a stationary tab provided on an outermost portion of the outer perimeter of the second plate to extend toward the first plate; and a slidable member provided on a outermost portion of the outer perimeter of the first plate to extend toward the second plate, the slidable member including a vertical portion that slides to engage and thereby latch the stationary tab.

19. The method of solvent-proofing a visor of a ball cap to be cleaned with a solvent, comprising:

providing the laundry device according to claim 18; and opening the hinges to insert the visor of the ball cap into the laundry device, closing the hinges, and sliding the vertical portion of the slidable member to engage the stationary tab and establish the sealing engagement.

20. The method of solvent-proofing a visor of a ball cap to be cleaned with a solvent, comprising:

providing the laundry device according to claim 8; and opening the hinges to insert the visor of the ball cap into the laundry device, closing the hinges, and sliding the vertical portion of the slidable member to engage the stationary tab and establish the sealing engagement.

* * * * *